US006914578B1

(12) United States Patent
Menahem

(10) Patent No.: US 6,914,578 B1
(45) Date of Patent: Jul. 5, 2005

(54) PEDESTAL SYSTEM AND METHOD OF CONTROLLING ROTATIONAL AND BEARING STIFFNESS

(76) Inventor: Israel Menahem, 2049 Larchmont Way, Clearwater, FL (US) 33764

( * ) Notice: Subject to any disclaimer, the term of this patent is extended or adjusted under 35 U.S.C. 154(b) by 60 days.

(21) Appl. No.: 10/657,921

(22) Filed: Sep. 9, 2003

(51) Int. Cl.[7] ..... H01Q 1/12; H01Q 3/00
(52) U.S. Cl. ..... 343/877; 343/765
(58) Field of Search ..... 343/765, 766, 343/880, 877

(56) References Cited

U.S. PATENT DOCUMENTS 5,453,753 A * 9/1995 Cosenza et al. ..... 343/765
5,517,204 A * 5/1996 Murakoshi et al. ..... 343/765
5,990,843 A * 11/1999 Knapp ..... 343/765
6,023,247 A * 2/2000 Rodeffer ..... 343/765

* cited by examiner

*Primary Examiner*—Don Wong
*Assistant Examiner*—Hung Tran Vy
(74) *Attorney, Agent, or Firm*—Edward P. Dutkiewicz

(57) ABSTRACT

A pedestal system comprises a base having a lower cylinder and an upper rotatably supported with respect to the lower vertical cylinder. A lower motor is coupled between the lower and upper cylinders to selectively cause rotational motion between the cylinders. Also provided is a top-most horizontal cylinder with a rotating shaft. The shaft has a bearing coupling the top-most horizontal shaft with respect to the upper vertical cylinder. Finally, an upper motor is provided. The upper motor is coupled between the top-most horizontal shaft and upper cylinder to selectively cause a rotational motion between the top-most horizontal shaft and the upper vertical cylinders.

7 Claims, 9 Drawing Sheets

FIG 5
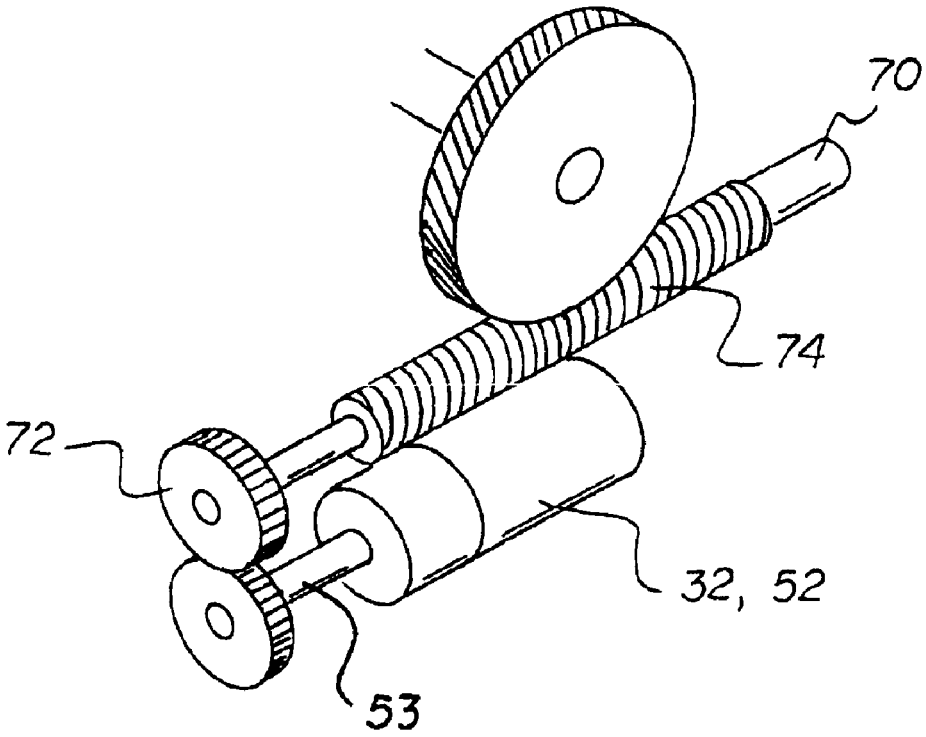
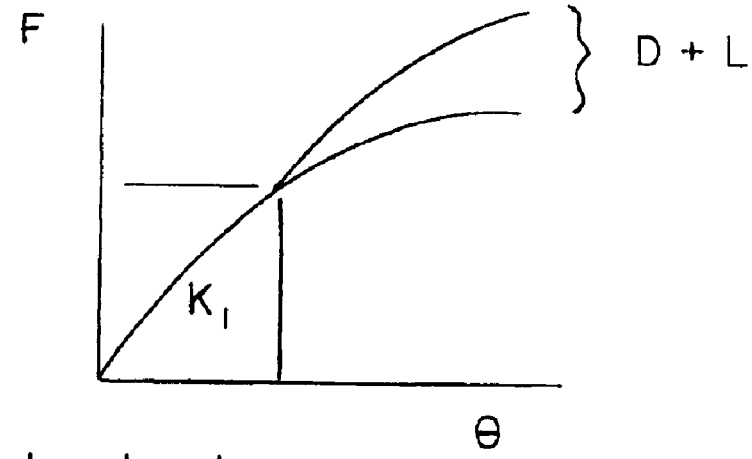
$$\frac{1}{K} = \frac{1}{K_1} + \frac{1}{K_2}$$
FIG 6

FIG 8
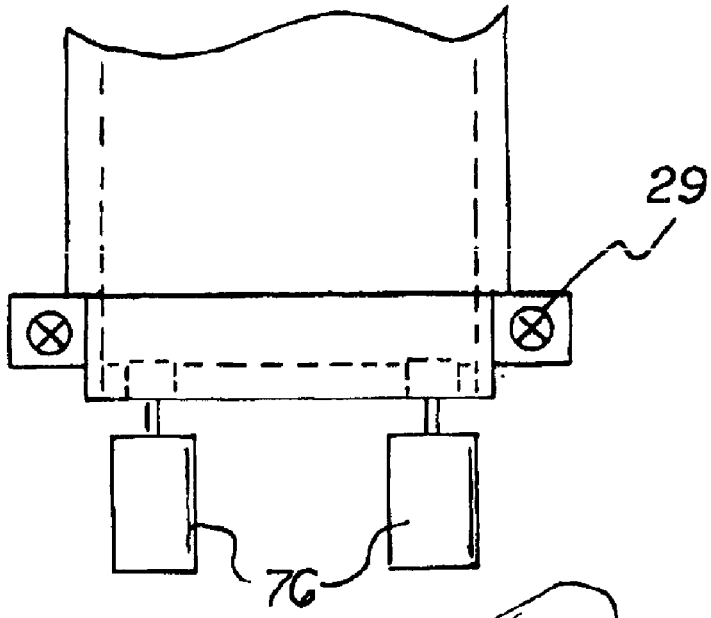
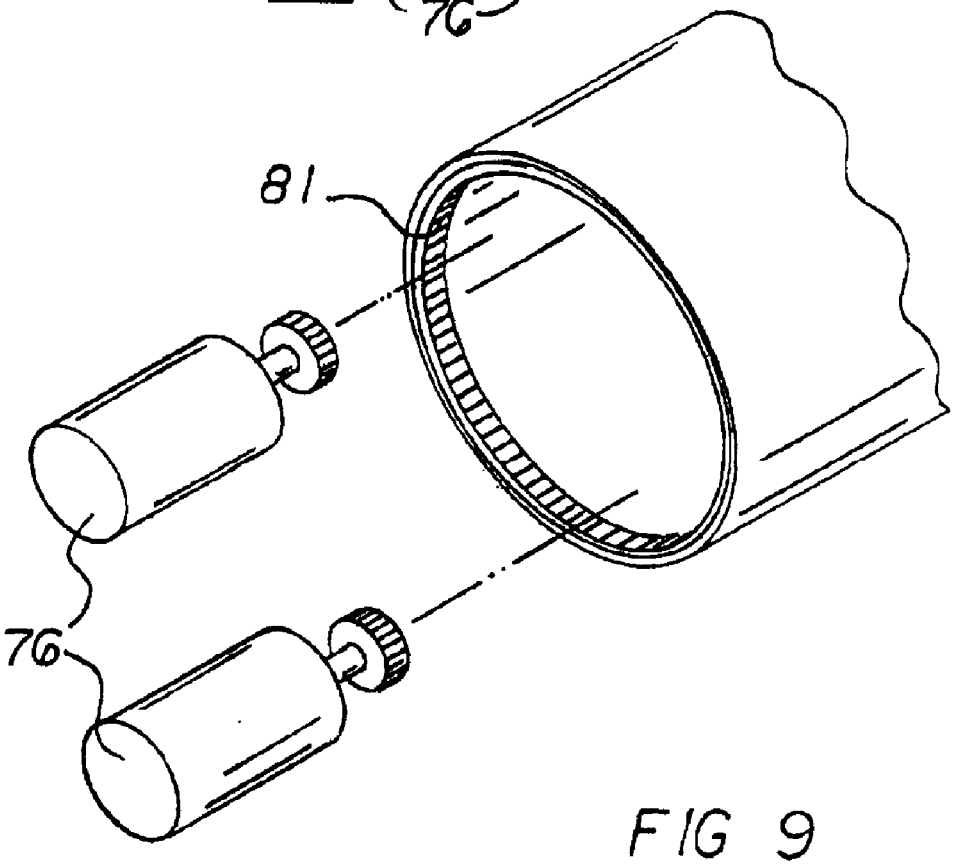
FIG 9

FIG 10
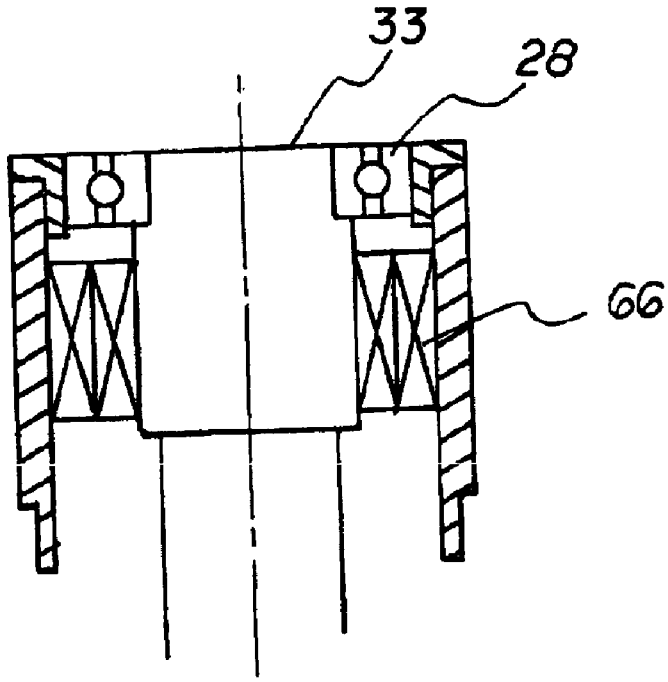
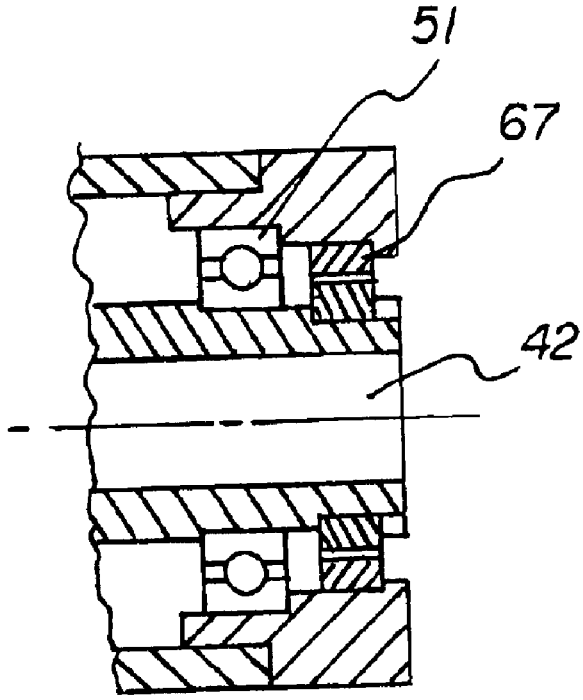
FIG 11

PEDESTAL SYSTEM AND METHOD OF CONTROLLING ROTATIONAL AND BEARING STIFFNESS

BACKGROUND OF THE INVENTION

1. Field of the Invention

The present invention relates to a pedestal system and more particularly pertains to supporting any of a plurality of objects at any of a plurality of angular orientations.

2. Description of the Prior Art

The use of pedestals and supports of known designs and configurations is known in the prior art. More specifically, pedestals and supports of known designs and configurations previously devised and utilized for the purpose of providing variable support for objects through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,877,459 to Brown discloses an antenna pedestal mount. U.S. Pat. No. 5,453,753 to Cosenza et al discloses a mechanically steerable modular planar patch array antenna. U.S. Pat. No. 4,663,635 to Wu discloses a mount to parabolic antenna or the like. U.S. Pat. No. 4,225,868 to Mazur discloses a low-profile X-Y antenna pedestal. U.S. Pat. No. 5,216,431 to Sinyard et al discloses a pedestal assembly having an RFI/EMI labyrinth shield. U.S. Pat. No. 5,419,521 to Matthews discloses a three-axis pedestal. U.S. Pat. No. 5,990,843 to Knapp discloses a highly-stiffened, dual-axle antenna tracking pedestal. U.S. Pat. No. 3,860,931 to Pope et al discloses a ship-borne gravity stabilized antenna. U.S. Pat. No. 3,999,184 to Fuss, III discloses a satellite tracking antenna apparatus. U.S. Pat. No. 5,517,204 to Murakoshi et al discloses an antenna directing apparatus. Lastly, U.S. Pat. No. 6,023,247 to Rodeffer discloses a satellite dish antenna stabilizer platform.

While these devices fulfill their respective, particular objectives and requirements, the aforementioned patents do not describe a pedestal system that allows supporting any of a plurality of objects at any of a plurality of angular orientations.

In this respect, the pedestal system according to the present invention substantially departs from the conventional concepts and designs of the prior art, and in doing so provides an apparatus primarily developed for the purpose of supporting any of a plurality of objects at any of a plurality of angular orientations.

Therefore, it can be appreciated that there exists a continuing need for a new and improved pedestal system which can be used for supporting any of a plurality of objects at any of a plurality of angular orientations. In this regard, the present invention substantially fulfills this need.

SUMMARY OF THE INVENTION

In view of the foregoing disadvantages inherent in the known types of pedestals and supports of known designs and configurations now present in the prior art, the present invention provides an improved pedestal system. As such, the general purpose of the present invention, which will be described subsequently in greater detail, is to provide a new and improved pedestal system and method which has all the advantages of the prior art and none of the disadvantages.

To attain this, the present invention essentially comprises several components. First provided is a base having a lower vertical cylinder and an upper vertical cylinder. Each cylinder has an interior surface and an exterior surface. The lower vertical cylinder is fixedly supported with respect to a recipient surface. The upper vertical cylinder is coupled to the base and rotatably supported with respect to the lower vertical cylinder. The upper and lower vertical cylinders sharing a common vertical axis. Next provided is a first bearing/motor/main-shaft subassembly coupling the upper and lower vertical cylinders of the base. The subassembly comprises a main-shaft having an upper portion with an upper end, and a lower portion with a lower end. The upper portion of the main-shaft is fixedly coupled to the upper vertical cylinder. The upper portion of the main-shaft has a bearing seat with a lip. The main-shaft has an upper end bearing. The main-shaft is coupled to the upper and lower cylinders of the base and has a circumferential ring gear coupled thereto. The upper bearing is located on the upper end of the main-shaft. The upper bearing is a 4 point contact bearing, also known as an X bearing. The subassembly has at least one motor coupled to the interior surface of the lower vertical cylinder. Each motor has a drive shaft with a drive gear. The drive gear engages the ring gear of the main-shaft thereby allowing rotation of the upper vertical cylinder with respect to the lower vertical cylinder. Next provided is a horizontal cylinder having an interior surface and an exterior surface. The horizontal cylinder has a second bearing/motor/main-shaft subassembly. The subassembly has a main-shaft with a right portion with a right end and a left portion with a left end. The right and left main-shaft ends each have an end cap coupled thereto. The left portion of the mainshaft has a bearing seat with a lip. The right portion of the main-shaft has a bearing seat with a lip. The subassembly has a left bearing and a right bearing. The left bearing is a 4 point contact bearing and the right bearing is a Conrad bearing. The main-shaft has a circumferential ring gear coupled thereto. The subassembly has at least one motor that is fixedly coupled to the interior surface of the upper vertical cylinder. Each motor has a drive shaft with a drive gear that is engaged with the ring gear that allows the rotation of the horizontal cylinder shaft. Lastly provided is a plurality of wires coupling each of the motors to a remote location. The remote location may be selectively energize the horizontal motor and the base motor to selectively vary the angular orientation of the top-most horizontal shaft vertically and horizontally and an object supported within.

A Method for achieving bearing and rotational stiffness is hereby provided. The method comprises several steps in combination. First step is providing a main-shaft having a first end and a second end and a ring gear. The each end of the main-shaft has a bearing seat. The next step is providing an X bearing having a negative clearance. The X bearing is coupled to the bearing seat of the main-shaft. The negative clearance is between about 0.00015 and .0004 inches. The next step is providing a Conrad bearing. The Conrad bearing is coupled to the second end of the main-shaft. The next step is providing a motor having a drive shaft with a drive gear. The motor has a turning rate of between about 2000 and 8000 RPM. The next step is providing a gear shaft. The gear shaft has a reduction gear and a worm gear coupled thereto. The reduction gear engages with the drive gear of the drive shaft and having a reduction rate of between about 2:1 and 5:1. The worm gear engages to the ring gear of the main shaft. The worm gear and the ring gear have a reduction rate of between about 100:1 and 400:1. The aforementioned steps allow for a gear reduction. The gear reduction allows the turning of the ring gear at a rate of between about 2 and 20 RPM resulting in the worm gear and the ring gear having a high stiffness and the bearings having a high stiffness, thereby providing for a high rotational stiffness.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pedestal system which has all of the advantages of the prior art pedestals and supports of known designs and configurations and none of the disadvantages.

It is another object of the present invention to provide a new and improved pedestal system which may be easily and efficiently manufactured and marketed.

It is further an object of the present invention to provide a new and improved pedestal system which is of durable and reliable constructions.

An even further object of the present invention is to provide a new and improved pedestal system which is susceptible of a low cost of manufacture with regard to both materials and labor, and which accordingly is then susceptible of low prices of sale to the consuming public, thereby making such pedestal system economically available to the buying public.

Even still another object of the present invention is to provide a pedestal system for supporting any of a plurality of objects at any of a plurality of angular orientations.

Lastly, it is an object of the present invention to provide a new and improved pedestal system comprising a base. The base has a lower cylinder and an upper cylinder rotatably supported with respect to the lower vertical cylinder. A lower motor is coupled between the lower and upper cylinders to selectively cause rotational motion between the cylinders. Also provided is a top-most horizontal shaft. The shaft supports an object with a bearing coupling the top-most horizontal shaft with respect to the upper vertical cylinder. Finally, an upper motor is provided. The upper motor is coupled between the top-most horizontal shaft and upper cylinder to selectively cause a rotational motion between the top-most horizontal shaft and the upper vertical cylinders.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a top perspective of the motor, ring gear and worm gear/reduction gear configuration.

FIG. 6 is a graph showing the additive stiffness of the X bearing and the Conrad bearing when used in conjunction.

FIG. 8 is a side view of the dual synchronized drive motors coupled to the internal ring gear of the shaft.

FIG. 9 is an exploded view of the dual synchronized drive motors and the internal ring gear of the shaft.

FIG. 10 is a side cross sectional view of the vertical shaft, bearing and direct drive motor of the invention.

FIG. 11 is a side cross sectional view of the horizontal shaft, bearing and resolver of the invention.

The same reference numerals refer to the same parts throughout the various Figures.

DESCRIPTION OF THE PREFERRED EMBODIMENTS

Figure 1:
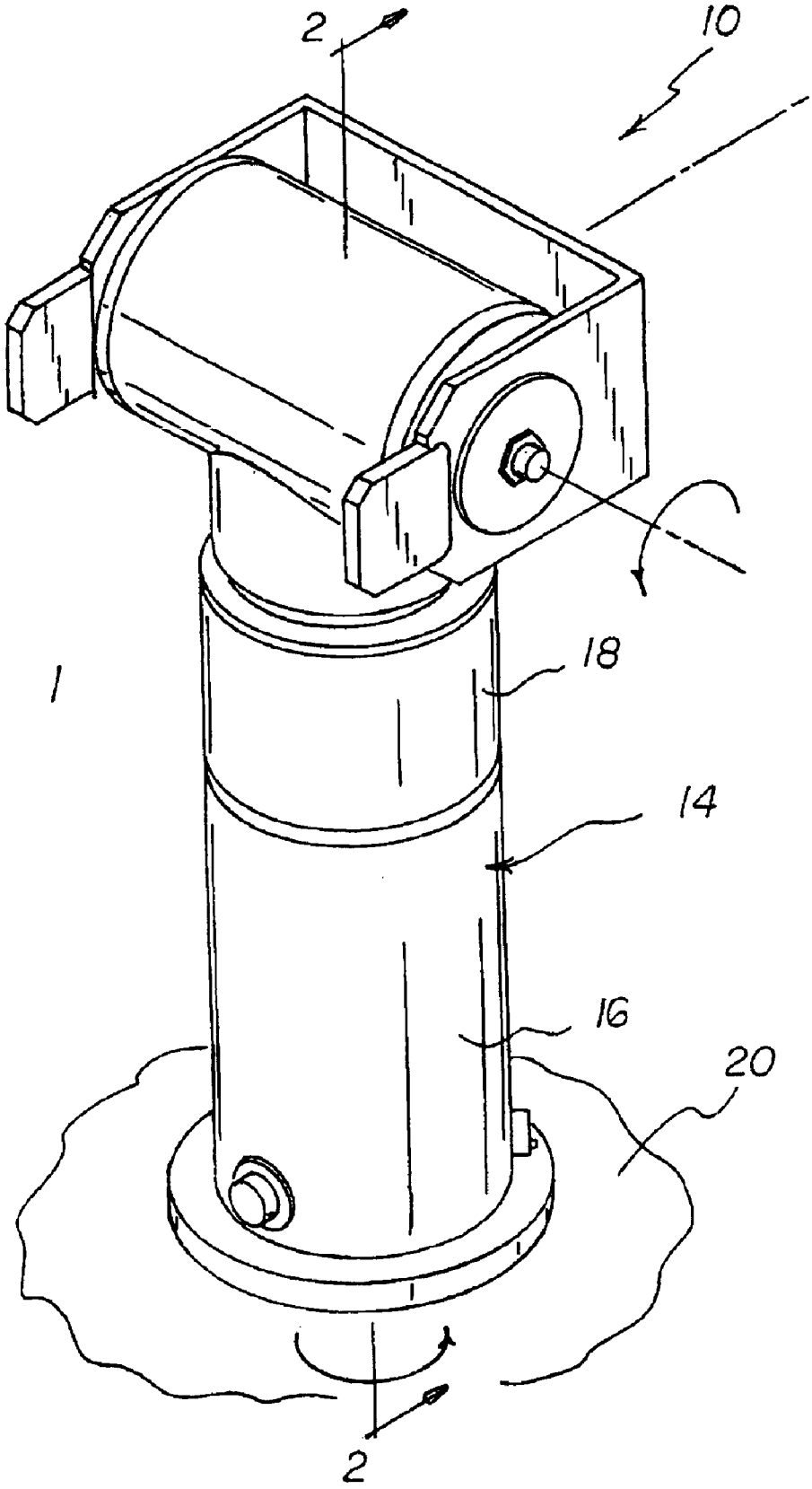
FIG. 1 is a perspective view of a pedestal system constructed in accordance with the principles of the present invention.
Figure 2:
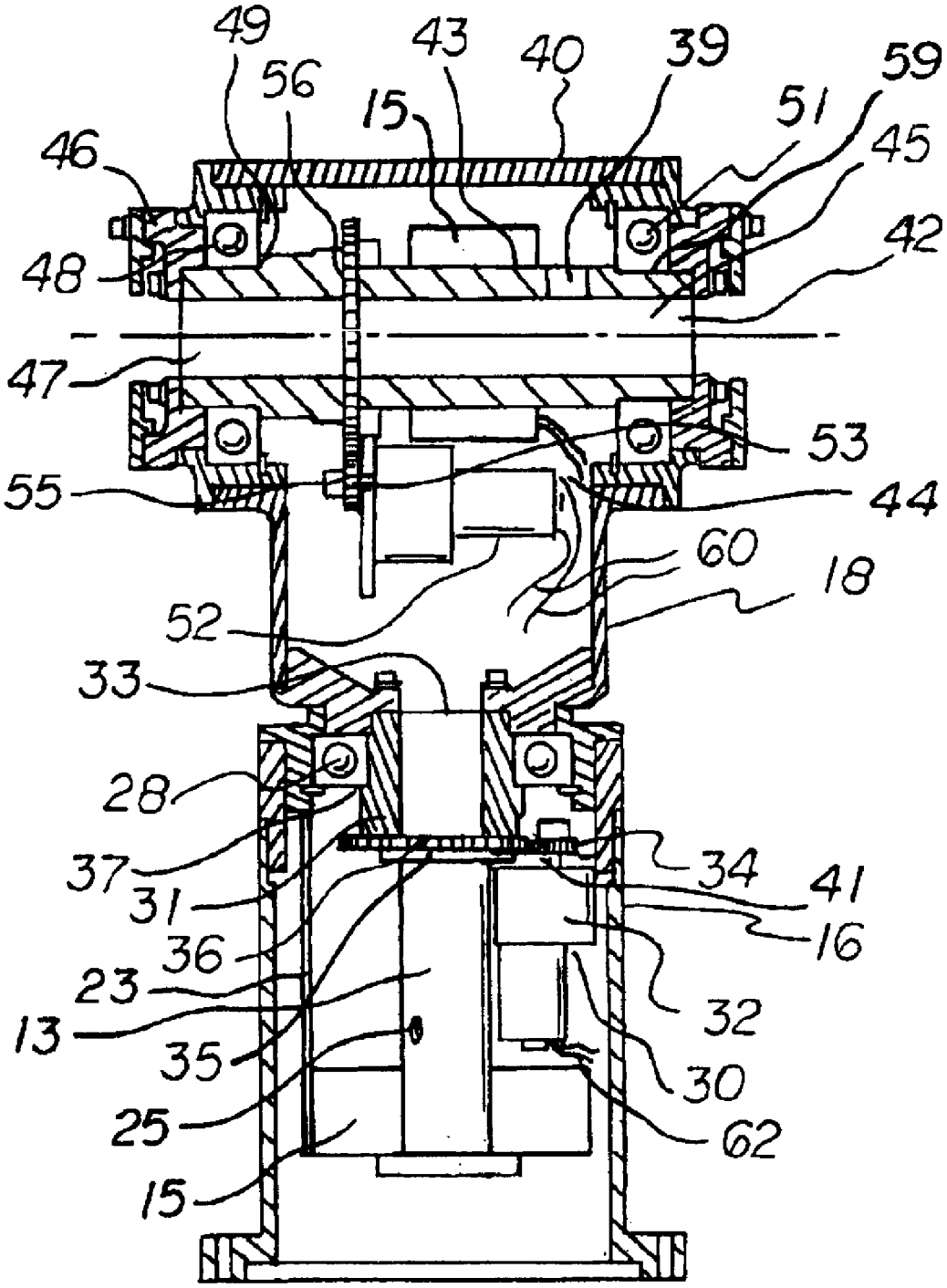
FIG. 2 is a cross-sectional view taken along Line 2—2 of FIG. 1.
Figure 3:
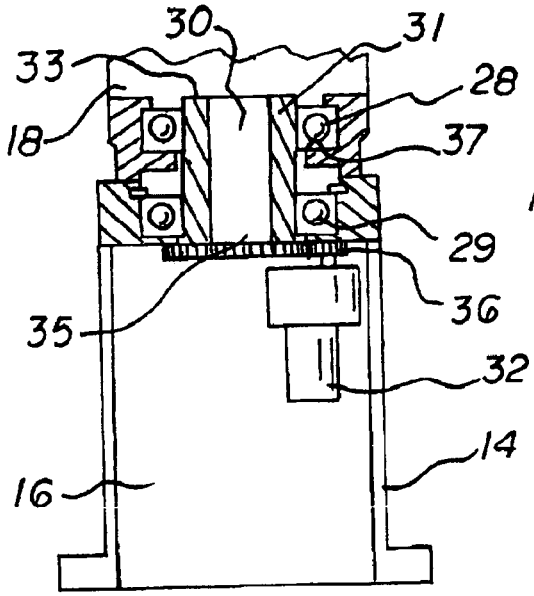
FIG. 3 is a side elevation cross section of base of the invention, showing the use of the X bearing and Conrad bearing to achieve an increased stiffness.
Figure 4:
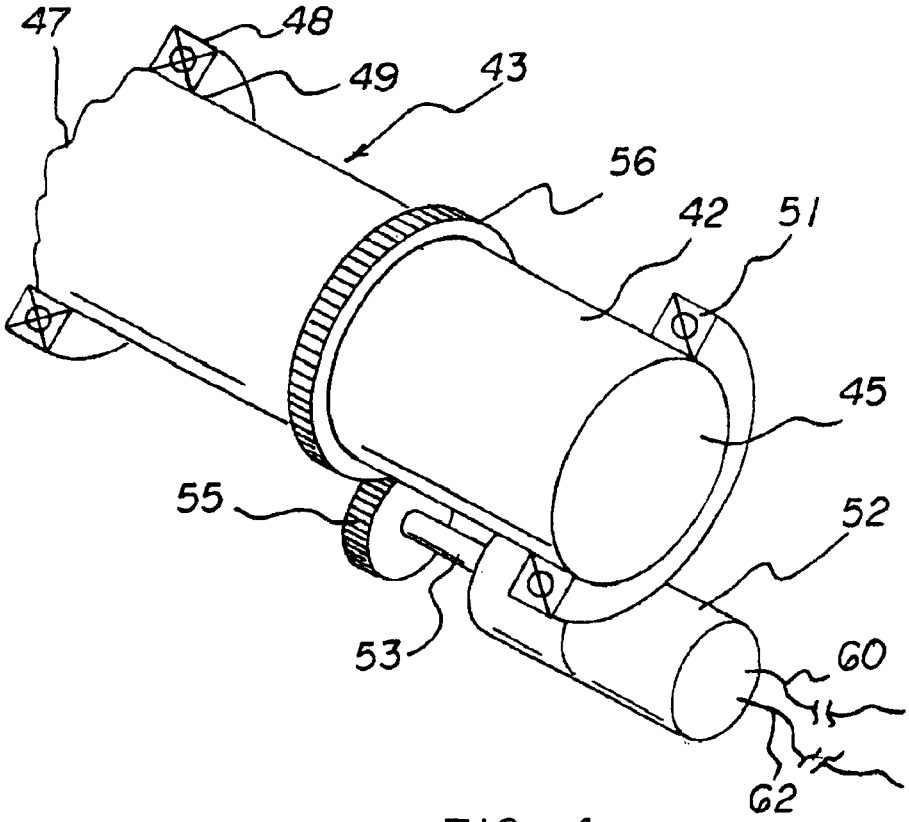
FIG. 4 is a top perspective of a shaft with ring gear and the X bearing/Conrad bearing configuration.
Figure 7:
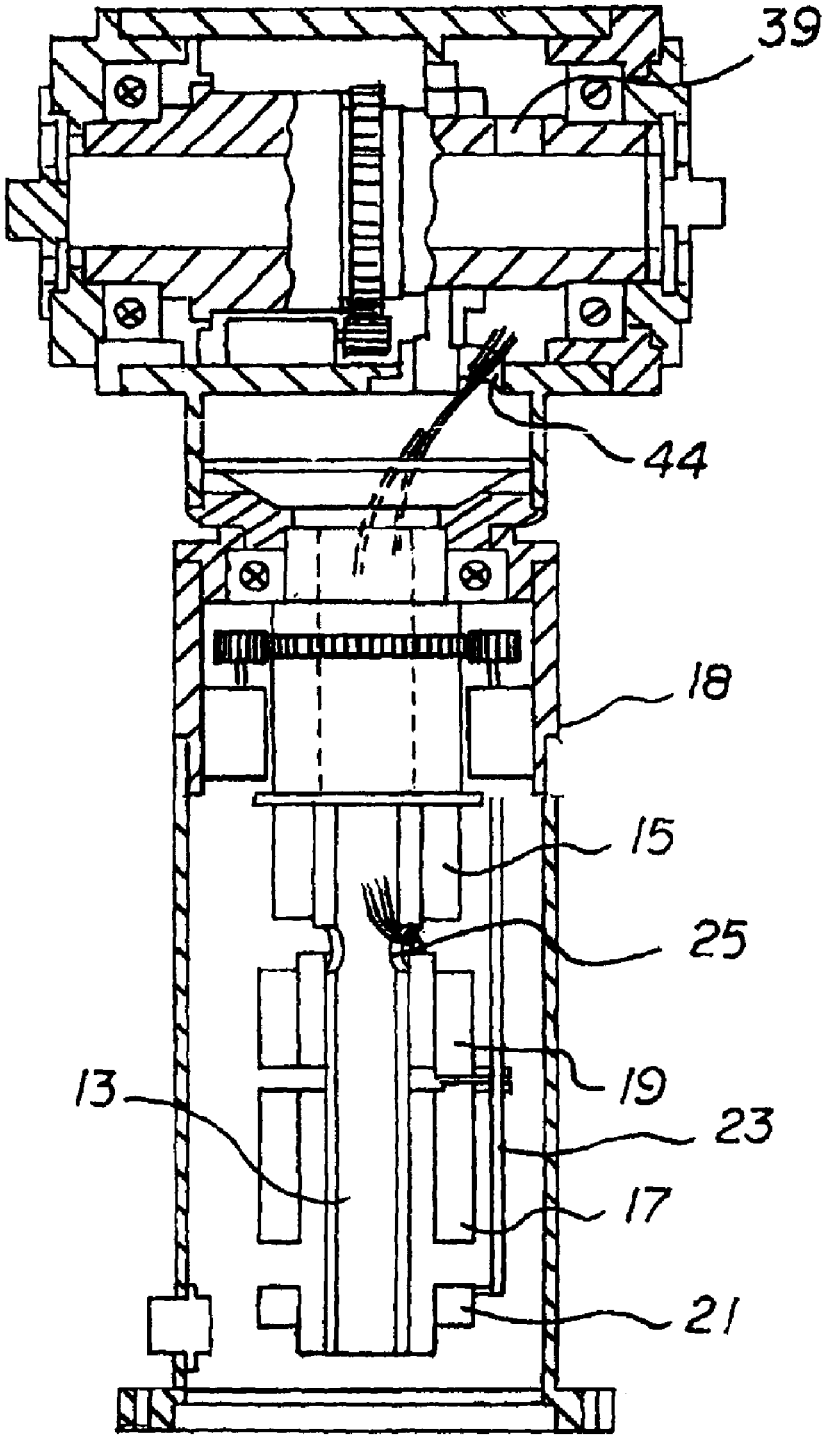
FIG. 7 is an side interior view of the pedestal system.
Figure 12:
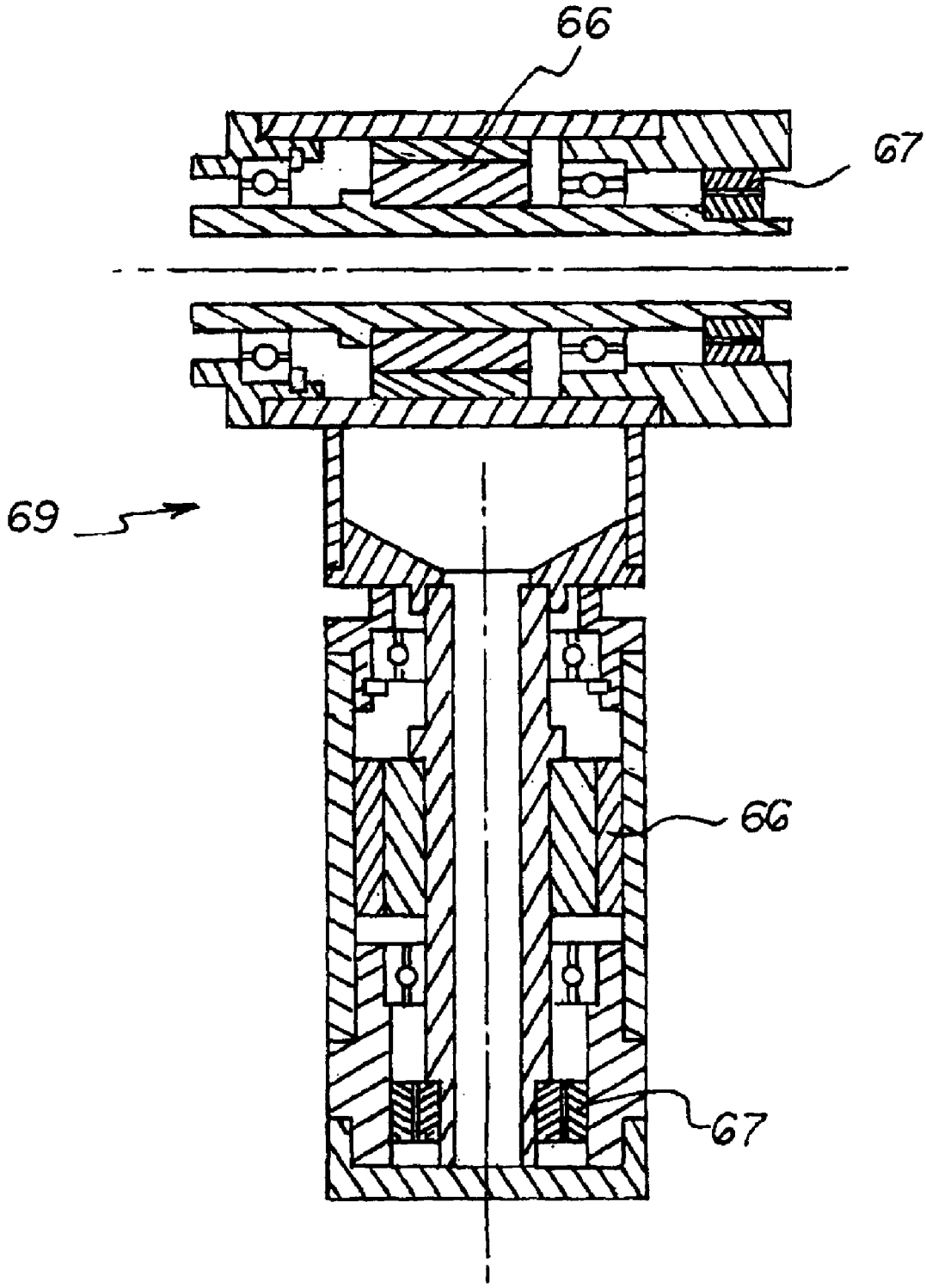
FIG. 12 is a side cross sectional view of the invention showing the interchangeability of the horizontal and vertical shaft and drive components.

With reference now to the drawings, and in particular to FIG. 1 thereof, the preferred embodiment of the new and improved pedestal system embodying the principles and concepts of the present invention and generally designated by the reference numeral 10 will be described.

The present invention, the pedestal system 10 is comprised of a plurality of components. Such components in their broadest context include a base, a lower motor, a horizontal shaft, and an upper motor. Such components are individually configured and correlated with respect to each other so as to attain the desired objective.

A pedestal system 10 for supporting any of a plurality of objects at any of a plurality of angular orientations. The system comprises several components in combination.

First provided is a base 14 having a lower vertical cylinder 16 and an upper vertical cylinder 18. Each cylinder has an interior surface and an exterior surface. The lower vertical cylinder is fixedly supported with respect to a recipient surface 20. The upper vertical cylinder is coupled to the base and rotatably supported with respect to the lower vertical cylinder. The upper and lower vertical cylinders sharing a common vertical axis.

Next provided is a first bearing/motor/main-shaft subassembly 30 coupling the upper and lower vertical cylinders of the base. The subassembly comprises a tubular azimuth main-shaft 31 having an upper portion with an upper end 33, and a lower portion with a lower end 35. The upper portion of the azimuth main-shaft is fixedly coupled to the upper vertical cylinder.

The upper portion of the main-shaft has a bearing seat with a lip 37. The azimuth main-shaft is coupled to the upper and lower cylinders of the base and has a circumferential ring gear 36 coupled thereto. The azimuth main-shaft has an upper bearing 28.

In an alternate configuration the azimuth main-shaft may also have a lower bearing 29. It should be noted that when an upper and lower bearing are used, a direct drive motor must be use instead of a motor/ring gear combination. In this embodiment a resolver 67 or encoder may be coupled to a shaft end. It should be noted that this system is designed so that it may be configures where the azimuth and elevational shaft assemblies may being interchangeable 69.

The upper bearing is located on the upper end of the main-shaft. The upper bearing is a 4 point contact bearing, also known as an X bearing. The lower bearing, when present, is located on the lower end of the main-shaft, the lower bearing being a Conrad bearing. The combination of the X Bearing and the Conrad bearing provides a heretofore unexpected additive stiffness, with the diameter "D" of the X bearing having a stiffness of K1 and the length between the X bearing and the Conrad bearing "L" having a stiffness of K2, the sum of the stiffness being 1/K=1/K1+1/K2.

The subassembly motor 32 is coupled to the interior surface of the lower vertical cylinder. The motor has a drive shaft 41 with a drive gear 34. The drive gear engages the ring gear of the main-shaft thereby allowing rotation of the upper vertical cylinder with respect to the lower vertical cylinder.

In an alternate configuration a direct drive motor 66 may be used. The direct drive motor allows for the use of a double bearing. The advantages of using a direct drive motor in the system is that there is a very low level of backlash and the system has a high degree of stiffness. When a motor/gear drive combination is employed the user will find that the amount of torque available is greater than the direct drive motor. Higher torques are possible with lower powered motors, such as 12 VDC and 24 VDC. The motor/gear combination enables the employment of a low angular velocity.

In another alternate configuration the motor/gear drive combination may be substituted with a motor/chain drive or a motor/belt drive.

A hollow torque tube 13 is coupled to the lower portion of the azimuth main-shaft. The torque tube is housed within the base of the system. The torque tube may be coupled with an encoder 15 or a resolver 17 or a slip ring 19 or a rotary joint 21. The slip ring may be anchored with a slip ring anchor 23 to prevent turning. The torque tube has an aperture 25 there into, to allow the passage of wires into the hollow torque tube.

Next provided is a horizontal cylinder 40 having an interior surface and an exterior surface and a wire hole 44 there into. The horizontal cylinder has a second bearing/motor/main-shaft subassembly 43. The second subassembly has a tubular main-shaft 42 with a right portion with a right end 45 and a left portion with a left end 47. The right and left main-shaft ends each have an end cap 46 coupled thereto. The main-shaft has an aperture 39 there into, to allow the passage of wires.

The left portion of the main-shaft has a bearing seat with a lip 49. The right portion of the main-shaft has a bearing seat with a lip 59. The subassembly has a left bearing 48 and a right bearing 51. The left bearing is a 4 point contact bearing and the right bearing is a Conrad bearing. The main-shaft has a circumferential ring gear 56 coupled thereto. The subassembly motor is fixedly coupled to the interior surface of the upper vertical cylinder. The motor 52 has a drive shaft 53 with a drive gear 55 that is engaged with the ring gear, that allows the rotation of the horizontal cylinder shaft through about 90 degrees.

Lastly provided is a plurality of wires 60, 62 coupling each of the motors to a remote location. The motor wires pass through the vertical shaft to the base. The remote location may be selectively energize the horizontal motor and the base motor to selectively vary the angular orientation of the top-most horizontal shaft vertically and horizontally and an object supported within.

In an alternative configuration, the Pedestal System may have a first bearing/motor/main-shaft subassembly in which the subassembly motor is coupled to the lower vertical cylinder. The motor has a drive shaft with a drive gear. The subassembly has a gear shaft 70 coupling the ring gear and the drive gear. The gear shaft has a reduction gear 72 and a worm gear 74. The worm gear engages the ring gear of the main-shaft. The reduction gear engages the drive gear of the motor thereby allowing rotation of the upper vertical cylinder with respect to the lower vertical cylinder.

In this alternative configuration the horizontal cylinder second bearing/motor/main-shaft subassembly has a motor that is coupled to the upper vertical cylinder. The motor 52 has a drive shaft 53 with a drive gear 55. The subassembly has a gear shaft 70 coupling the ring gear and the drive gear. The gear shaft has a reduction gear 72 and a worm gear 74. The worm gear engages the ring gear of the main-shaft. The reduction gear engages the drive gear of the motor thereby allowing rotation of the horizontal cylinder with respect to the upper vertical cylinder. The use of the motor/worm gear combination allows the user to take advantage of a high speed, low inertia motor. This combination allows for a great stiffness and smooth transition from position to position and minimal backlash.

In another alternate configuration the bearing/motor/main-shaft subassembly may have a plurality of electric motors 76 with each motor coupled to the ring gear. The dual motors are synchronized to produce no backlash. The dual motor configuration is also known as a dual-drive configuration.

In another alternate configuration the end of the shaft may have an internal periphery gear and the synchronized dual-drive motors are engaged with the internal periphery gear 81 to provide no backlash when being operated.

In an alternative configuration, the Pedestal System may have only one X bearing per shaft.

A drive means, when referred to, includes all motive means and coupling means to effectuate the function of rotation of a shaft. A drive means may be a direct drive motor coupled to a shaft. A drive means may be a motor with a shaft and a gear which engages a ring gear coupled to a shaft. It can also be a plurality of motors which engage an internal periphery gear of a shaft, such as in a synchronized drive. A drive means can be a motor with a drive gear engaging a reduction on a shaft which has a worm gear, also engaging a ring gear of a shaft. Motors can be electric, high and low voltage. Motors can also be pneumatic or hydraulic.

The basic design of this invention is a Direct Drive System, hereinafter "DDS", which can be implemented in two degrees of freedom (DOF). In FIG. 1 there is a motor along the shaft having a bearing coupled thereto. Coupled to the shaft is a torque tube, with an encoder or resolver. The motor employed may be a brushed or brushless type. This full assembly is a Single Degree of Freedom Drive. In the elevation over azimuth configuration we have one of the drives, or gimbals, in a horizontal position and the other is in a vertical or azimuth position.

Figure 13:
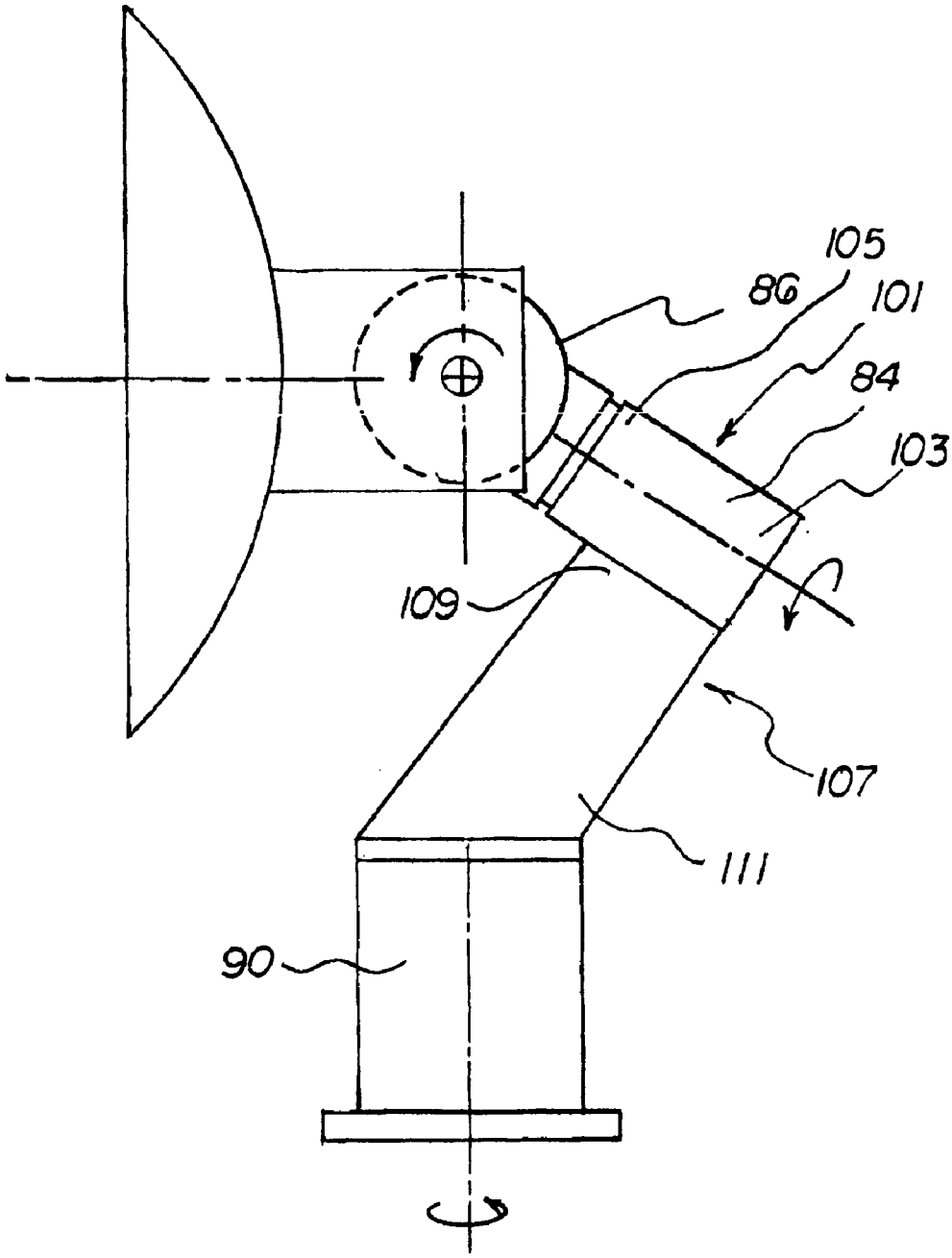
FIG. 13 is a side elevation view of the system with the intermediate arm for marine application.

In marine applications there may be a need to have the line of sight in 90 degrees to the horizon. As the sensor cannot be at cos(90), there is a need for a third axis (FIG. 13) in which an intermediate, or cross level, gimbal is employed. The combination of an azimuth gimbal 90 and a cross level gimbal 84 and an elevation gimbal 86 meets and overcomes the marine application obstacle. This is a three degree of freedom gimbaling system. One of the advantages of the three degrees of freedom gimbaling system is that the algorithm for control software is simplified.

In this alternate embodiment there is an intermediate cylinder, also known as a cross level cylinder 101. The cross level cylinder has a lower cross level cylinder 103 and an upper cross level cylinder 105 with each cylinder having an interior surface and an exterior surface and an upper end and a lower end. The lower end of the lower cross level cylinder is fixedly coupled to a link arm 107. The link arm has an upper end 109 and a lower end 111, the lower end of the link arm is fixedly coupled at an acute angle to the upper vertical cylinder and the upper end of the link arm is fixedly coupled at an acute angle to the lower end of the lower cross level cylinder. The coupling thereby allows an azimuth rotation of the arm. The upper cross level cylinder is coupled to the lower cross level cylinder and rotatably supported with respect to the lower cross level cylinder. The upper and lower cross level cylinders sharing a common axis.

A Method for achieving bearing and rotational stiffness is also hereby provided. The method comprises several steps in combination.

First step is providing a main-shaft having a first end and a second end and a ring gear. The first end of the main-shaft has a bearing seat.

The next step is providing an X bearing having a negative clearance. The X bearing is coupled to the bearing seat of the main-shaft. The negative clearance is preferably between about 0.00015 inches and 0.0004 inches but rigidity requirements of a system may be individually calculated and determined.

The next step is providing a high speed, low inertia motor having a drive shaft with a drive gear. The motor has a turning rate of between about 1000 and 8000 RPM.

The next step is providing a gear shaft. The gear shaft has a reduction gear and a worm gear coupled thereto. The reduction gear engages with the drive gear of the drive shaft and having a reduction rate of between about 2:1 and 5:1. The worm gear engages to the ring gear of the main shaft. The worm gear and the ring gear have a reduction rate of between about 100:1 and 400:1. The aforementioned steps allow for a gear reduction. The gear reduction allows the turning of the ring gear at a rate of between about 2 and 20 RPM resulting in the worm gear and the ring gear having a high stiffness and the bearings having a high stiffness, thereby providing for a high rotational stiffness.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pedestal system for supporting any of a plurality of objects at any of a plurality of angular orientations comprising, in combination:

a base having a lower vertical cylinder and an upper vertical cylinder with each cylinder having an interior surface and an exterior surface, the lower vertical cylinder being fixedly supported with respect to a recipient surface and the upper vertical cylinder being coupled to the base and rotatably supported with respect to the lower vertical cylinder, the upper and lower vertical cylinders sharing a common vertical axis;

the lower vertical cylinder housing a first bearing/motor/main-shaft subassembly coupling the upper and lower vertical cylinders of the base, the subassembly comprising a first hollow tubular main-shaft having an upper portion with an upper end and a lower portion with a lower end, the upper portion of the first main-shaft having a bearing seat with a lip with the upper portion of the first main-shaft being fixedly coupled to the upper vertical cylinder, the first main-shaft having a circumferential ring gear coupled thereto with the first main-shaft having an upper end bearing, the first main-shaft being coupled to the lower vertical cylinder by the bearing, the ring gear being below the bearing, the upper end bearing being a 4 point contact bearing, also known as an X bearing, the subassembly having at least one motor being coupled to the interior surface of the lower vertical cylinder, each motor having a drive shaft with a drive gear that engages the ring gear of the main-shaft thereby allowing rotation of the upper vertical cylinder with respect to the lower vertical cylinder;

a horizontal cylinder having an interior surface and an exterior surface, the horizontal cylinder having a second bearing/motor/main-shaft subassembly with the subassembly having a second hollow tubular main-shaft having an aperture there into, the second main-shaft having a right portion with a right end and a left portion with a left end, the right and left second main-shaft ends each having an end cap coupled thereto, with the left portion of the second main-shaft having a bearing seat with a lip, the subassembly having a left bearing and a right bearing, the left bearing being a 4 point contact bearing and the right bearing being a Conrad bearing, the second main-shaft having a circumferential ring gear coupled thereto, the subassembly having at least one motor being fixedly coupled to the interior surface of the upper vertical cylinder, each motor having a drive shaft with a drive gear that is engaged with the ring gear that allows the rotation of the horizontal cylinder shaft, with a position locator being from the class of position locators which includes resolvers and encoders being coupled to the shaft; and a plurality of wires coupling each of the motors to a remote location for selectively energizing the horizontal motor and the base motor to selectively vary the angular orientation of the top-most horizontal shaft vertically and horizontally and an object supported within.

2. A pedestal system comprising, in combination:

a base having a lower vertical cylinder and an upper vertical cylinder with the cylinders being coupled to each other and sharing a common vertical axis;

the lower vertical cylinder housing a first bearing/motor/main-shaft subassembly, the first main-shaft having at least one bearing seat with a lip, the assembly having at least one bearing with the first main-shaft being coupled to the lower vertical cylinder by at least one bearing, the first main-shaft being fixedly coupled to the upper vertical cylinder, the subassembly having a drive means coupled to the lower vertical cylinder to provide rotation of the first main-shaft;

a horizontal cylinder having a second bearing/motor/main-shaft subassembly, the second main-shaft having a right end and a left end, the main-shaft having at least one bearing seat with a lip, the subassembly having at least one bearing being a four-point contact bearing, also known as an x-bearing, the subassembly having a drive means coupled to the upper vertical cylinder, the motor having a drive means to provide rotation of the second main-shaft; and a plurality of wires coupling each of the drive means to allow a remote location for allowing the control of the drive means.

3. A Pedestal System as set forth in claim 2 wherein the first bearing/motor/main-shaft subassembly couples the upper and lower vertical cylinders of the base, the subassembly comprising a first main-shaft having an upper portion with an upper end and a lower portion with a lower end, with the upper portion of the first main-shaft being fixedly coupled to the upper vertical cylinder, the upper portion of the first main-shaft having a bearing seat with a lip, the first main-shaft being coupled to the upper and lower cylinders of the base and having a circumferential ring gear coupled thereto with the first main-shaft having an upper bearing and a lower bearing, the upper bearing being located on the upper end of the main-shaft, the upper bearing being a 4 point contact bearing, also known as an X bearing, the lower bearing being located on the lower end of the main-shaft, the lower bearing being a Conrad bearing, the subassembly drive means being a motor being coupled to the lower vertical cylinder, the motor being a direct drive motor and coupled to the first main-shaft thereby allowing rotation of the upper vertical cylinder with respect to the lower vertical cylinder;

a hollow torque tube being coupled to the lower end of the first main-shaft, the torque tube allowing the coupling of a position determination device;

a horizontal cylinder having an interior surface and an exterior surface, the horizontal cylinder having a second bearing/motor/main-shaft subassembly with the subassembly having a second main-shaft with a right portion with a right end and a left portion with a left end, the right and left shaft ends each having an end cap coupled thereto, with the left portion and the right portion of the second main-shaft each having a bearing seat with a lip, the subassembly having a left bearing and a right bearing, the left bearing being located on the left end of the main-shaft, the left bearing being a 4 point contact bearing, also known as an X bearing, the right bearing being located on the right end of the main-shaft, the right bearing being a Conrad bearing, the subassembly having a direct drive motor being coupled to the upper vertical cylinder and to the second main-shaft thereby allowing rotation of the horizontal cylinder with respect to the upper vertical cylinder, with a position determination device being coupled to the second main-shaft; and, a plurality of wires coupling each of the motors to a remote location for selectively energizing the horizontal motor and the base motor to selectively vary the angular orientation of the top-most horizontal shaft vertically and horizontally and an object supported within.

4. A Pedestal System as set forth in claim 2 wherein the bearing coupled to the shaft is an X-bearing.

5. A Pedestal System as set forth in claim 2 wherein the drive means is a motor/drive gear/reduction gear/worm gear combination.

6. A pedestal system for supporting any of a plurality of objects at any of a plurality of angular orientations comprising, in combination:

a base having a lower vertical cylinder and an upper vertical cylinder with each cylinder having an interior surface and an exterior surface, the lower vertical cylinder being fixedly supported with respect to a recipient surface and the upper vertical cylinder being coupled to the base and rotatably supported with respect to the lower vertical cylinder, the upper and lower vertical cylinders sharing a common vertical axis;

a first bearing/motor/main-shaft subassembly coupling the upper and lower vertical cylinders of the base, the subassembly comprising a first main-shaft having an upper portion with an upper end and a lower portion with a lower end, the upper portion of the first main-shaft having a bearing seat with a lip with the upper portion of the first main-shaft being fixedly coupled to the upper vertical cylinder, the first main-shaft having a circumferential ring gear coupled thereto with the first main-shaft having an upper end bearing, the ring gear being below the bearing, the upper end bearing being a 4 point contact bearing, also known as an X bearing, the subassembly having at least one drive means being coupled to the interior surface of the lower vertical cylinder, each drive means being coupled to the ring gear of the main-shaft thereby allowing rotation of the upper vertical cylinder with respect to the lower vertical cylinder;

an intermediate cylinder, also known as a cross level cylinder, having a lower cross level cylinder and an upper cross level cylinder with each cylinder having an interior surface and an exterior surface and an upper end and a lower end, the lower end of the lower cross level cylinder being fixedly coupled to a link arm, the link arm having an upper end and a lower end, the lower end of the link arm being fixedly coupled at an acute angle to the upper vertical cylinder and the upper end of the link arm being fixedly coupled at an acute angle to the lower end of the lower cross level cylinder, the coupling thereby allowing an azimuth rotation of the arm, the upper cross level cylinder being coupled to the lower cross level cylinder and rotatably supported with respect to the lower cross level cylinder, the upper and lower cross level cylinders sharing a common axis;

a third bearing/motor/main-shaft subassembly housed within the lower cross level cylinder, the subassembly comprising a third main-shaft having an upper portion with an upper end and a lower portion with a lower end, the third main-shaft having at least one bearing seat with a lip with the upper portion of the lower cross level cylinder main-shaft being fixedly coupled to the upper cross level cylinder, the third main-shaft having a circumferential ring gear coupled thereto with the third main-shaft having an upper end bearing, the ring gear being below the bearing, the upper end bearing being a 4 point contact bearing, also known as an X bearing, the subassembly having at least one drive means for providing rotation of the third main-shaft coupled to the interior surface of the lower cross level cylinder, each drive means coupled to the ring gear of the third main-shaft thereby allowing rotation of the upper cross level cylinder with respect to the lower cross level cylinder;

a horizontal cylinder having an interior surface and an exterior surface, the horizontal cylinder being fixedly coupled to the upper cross level cylinder having a second bearing/motor/main-shaft subassembly with the subassembly having a second main-shaft with a right portion with a right end and a left portion with a left end, the right and left main-shaft ends each having an end cap coupled thereto, with the main-shaft having at least one bearing lip, the subassembly having at least one bearing, the first bearing being a 4 point contact bearing, the second main-shaft having a circumferential ring gear coupled thereto, the subassembly having at least drive means being fixedly coupled to the interior surface of the upper cross level cylinder, each drive means being coupled to the ring gear and thereby allows the rotation of the horizontal cylinder shaft, with a position locator being from the class of position locators which includes resolvers and encoders being coupled to the third main-shaft; and a plurality of wires coupling each of the motors to a remote location for selectively energizing the horizontal motor and cross level and the base motor to selectively vary the angular orientation of the top-most horizontal shaft vertically and horizontally and an object supported thereto.

7. A pedestal system comprising, in combination:

a base having a lower vertical cylinder and an upper vertical cylinder with the cylinders being coupled to each other and sharing a common vertical axis;

the lower vertical cylinder housing a first bearing/motor/main-shaft subassembly, the first main-shaft having an upper end and a lower end and a bearing seat with a lip, the main-shaft being coupled to the lower vertical cylinder by at least one bearing, with the upper vertical cylinder being fixedly coupled to the upper end of the main shaft, the subassembly having a drive means to effectuate rotation of the main-shaft;

an arm link having an upper end and a lower end, the lower end fixedly coupled to the upper vertical cylinder;

a cross level cylinder having an upper cylinder and a lower cylinder, the lower cross cylinder fixedly coupled to the upper end of the arm link and housing a third bearing/motor/main-shaft subassembly, the third main-shaft having at last one bearing seat with a lip, the cross level third main-shaft being fixedly coupled to the upper cross level cylinder and the third main-shaft being coupled to the lower cross level cylinder by at least one bearing, the subassembly motor having a drive means to effectuate rotation of the main-shaft;

a horizontal cylinder having a second bearing/motor/main-shaft subassembly, the second main-shaft having a right end and a left end, the second main-shaft having at least one bearing seat with a lip, the subassembly having at least one bearing being a four-point contact bearing also known as an x-bearing the subassembly having a drive means to provide rotation of the main-shaft; and a plurality of wires coupling each of the drive means to a remote location for allowing the control of the drive means.

* * * * *